United States Patent [19]

Koehne

[11] 4,393,691

[45] Jul. 19, 1983

[54] RAIL VEHICLE FOR TRACK INVESTIGATION

[76] Inventor: Hermann D. Koehne, Printroper Str. 555, D-4300 Essen 11, Fed. Rep. of Germany

[21] Appl. No.: 301,365

[22] Filed: Sep. 11, 1981

[30] Foreign Application Priority Data

Sep. 15, 1980 [DE] Fed. Rep. of Germany ..... 3034704

[51] Int. Cl.[3] ..... G01N 3/42

[52] U.S. Cl. ..... 73/84; 73/146

[58] Field of Search ..... 73/146, 84

[56] References Cited

U.S. PATENT DOCUMENTS

| | | | |
|---|---|---|---|
| 2,130,751 | 9/1938 | Van Der Meer | 73/84 |
| 2,774,240 | 12/1956 | Fehlmann | 73/84 |
| 4,040,292 | 8/1977 | Theurer et al. | 73/84 |
| 4,302,967 | 12/1981 | Dufey | 73/84 |
| 4,315,429 | 2/1982 | Morozov | 73/84 |

*Primary Examiner*—Donald O. Woodiel
*Attorney, Agent, or Firm*—Horst M. Kasper

[57] ABSTRACT

A rail vehicle for track investigation is provided which comprises an excavator attached to said vehicle for removing material supporting the rails and disposed below the rail level, a support provision attached to the rail vehicle and a measurement unit attached to the support provision. The measurement unit includes a frame supported by the support provision, a pressure plate held by the frame and capable of being lowered down to below the formation level and of being lifted up and disposed in its upper rest position such that it is at a level above the track region for preventing interference with line travel and a pressure piston adapted to an opening in said pressure plate and capable of substantially vertical motion relative to the pressure plate for pressing into the subgrade to be tested.

24 Claims, 7 Drawing Figures

RAIL VEHICLE FOR TRACK INVESTIGATION

DESCRIPTION

BACKGROUND OF THE INVENTION

1. Field of the Invention

The present invention relates to a rail vehicle for providing work relating to the track, preferably self-propelled, comprising an excavator including a narrow gripper and disposed near an end of the rail vehicle.

2. Brief Description of the Background of the Invention Including Prior Art

Rail vehicles for providing work relating to the track are known and such a rail vehicle is for example disclosed in German Democratic Republic Pat. No. 61,805. Such machines allow to perform different kinds of work at the rail and such rail vehicles are frequently called multi-purpose vehicles. Such machines are frequently self-propelled by their own drive units. For this purpose in most cases a cabin is provided disposed at the side of the rail vehicle opposite to the location of the excavator.

In order to perform measurements at the track body or at the rail bed additional measurement devices are required. The above cited GDR Patent is not equipped for the investigation of soil mechanics. In the practical performance of such investigations there was cleared out the interspace between two cross-ties at predetermined distances along the track and then several days later inspected by eye, then again filled in, packed and tamped. Thus the investigated rail section could not be used for rail traffic for several days. In case the track was used, then the surrounding material already had partially filled the dug out hole again.

For measuring and checking of the soil mechanics in the area of the formation level a pressure piston method is known. For this purpose a cylinder with a diameter of about 5 cm is pressed into the ground to be investigated with a constant speed and the pressure to do this is determined. In order for the ground around the pressure piston not to well up lead rings or half lead rings are placed around the pressure piston. These are to simulate the pressure situations at the same time, which prevail usually in the region of the investigated bed in the presence of an upper structure.

It is the purpose of the investigation of soil mechanics to determine early damages in the region of the formation level, before these can become effective for the rail section proper. On the other hand soil mechanics are also investigated in order to avoid unnecessary expenses of work to be performed based on an underestimate of the ground material.

Usually, there is a ballast bed disposed below the cross-ties of a railroad rail and the ballast bed can have varying thickness, and in typical cases the ballast bed from broken stones reaches to 50 cm below the upper edge of the rail. The lower boundary of this ballast bed is designated as formation level or subgrade. The soil mechanics investigated here refer to the lower disposed region, which is called here formation level region.

Upon traffic passing the ballast bed having a certain amount of elasticity transfers the load of the train to the formation level. Under the load of the train and in particular under the load of the axles of the locomotive a rail is pressed down from its rest position frequently by several centimeters. Similarly the elastic ballast bed is pressed together. With the load removal the ballast bed expands again and the rail takes on again its usual rest position. These load changes repeat upon passing of a train over a point considered many times and the formation level is loaded with a pulsating pressure. In case the formation level is wet such as for example caused by inadequate drainage, then by way of the continuous pumping motions the mud moves upward in the ballast bed into the region of the rails. This changes the physical conditions of the upper structure drastically, and the upper structure is not any longer elastic and disturbances of the traffic operation occur.

An insufficient capability of support of the under structure of railroad tracks results primarily in the following damages:

continuous occurrance of level and directional errors of the rail;

increased maintenance requirements;

areas with speed limitations; and premature wear of upper structure and of the rail vehicles.

The drainage of the formation level is one of the most important preconditions for the stability of the track. The depositing of residues upon machine cleaning at the foot of the bed near the edge path and filled, soiled, grown in or too flat rail ditches interfere with the flow off of the rain water on the formation level and in the rail ditch or side drain. This results in the water penetrating the subgrade and slowly softening the subgrade.

Reliable measurement procedures are known for determining the state of the formation level. However, since the investigation of the soil mechanics is in particular necessary and of prime importance with high traffic lines, where a temporary placing out of service would result in drastic timetable curtailments the necessary steps have frequently not been performed. For safety reasons and in order to increase the speed of the trains passing and the weight on the axles such investigations of the formation level are indispensable. However, no suitable measuring devices are presently available for this purpose. The performance of the known method is much too slow and too time consuming and labor intensive and the practical performance does not always lead to reliable values as in particular measuring errors cannot always be excluded. For safety purposes frequently a decision is made for precautionary improvements of the formation level, especially for exchange work. However these amount to more than $100,000 per kilometer of the track.

SUMMARY OF THE INVENTION

1. Purposes of the Invention

It is an object of the invention to provide a rail vehicle suitable for a rapid and precise testing and investigation of the soil mechanics in the area of the formation level such that also during short intervals of non-operation investigations can be performed for high-traffic lines without interference with the timetable of the traffic.

It is another object of the invention to provide a rail vehicle for investigation of the formation level where the tested locations can immediately or shortly after the required testing be filled, packed and tamped again.

It is a further object of the present invention to provide a rail vehicle providing automatic evaluation of measurement data relating to subgrade investigations and which can be moved easily and which can be operated with ease and without errors.

These and other objects and advantages of the present invention will become evident from the description which follows.

2. Brief Description of the Invention

The present invention provides a rail vehicle for track investigation which comprises means attached to said vehicle for removing supporting material of the track disposed below the rail level, a support provision attached to the rail vehicle, and a test unit attached to the support provision. The test unit includes a frame supported by the support provision, a pressure plate held by the frame and capable of being lowered down to below the formation level as well as of being lifted up and disposed in its upper rest position such that it is at a level above the track region for preventing interference with line travel, and a pressure piston adapted to an opening in said pressure plate and capable of substantially vertical motion relative to the pressure plate for pressing into the subgrade to be tested.

A drive system can be attached to the rail vehicle for providing power for moving the rail vehicle as a self propelled vehicle. The means for removing supporting material can include an excavator and a narrow gripper built on the excavator. The means for removing supporting material can be adapted for clearing of the interspace between cross-ties including the side areas down to the foundation level.

The pressure plate can be adapted for providing a steady contact pressure on the surface to be tested. The test unit can be guided for motion horizontally and cross to the direction of motion of the rail vehicle. The supporting provision can include a girder running cross to the direction of motion of the rail vehicle and a support arm connecting the girder to the rail vehicle and disposed at the end of the rail vehicle body and protruding freely beyond the bumpers of the rail vehicle. The girder can be connected to the support arm through a jack and can be lowered to the rails while the rail vehicle is lifted up loading with its weight the support arm for providing a reference plane. The support provision can be located at the same side end of the vehicle where the means for removing supporting material is disposed and the supporting provision and the test unit can comprise a handle for being engaged by the means for removing such that the test unit can be placed on the rail vehicle after an investigation is ended. Preferably the handle is an eyelet.

A hydraulic jack can be disposed vertically between the frame and the pressure plate, where the pressure plate is located below the frame, and said jack can engage the pressure plate with a joint. A displacement pick-up can be disposed between the frame and the pressure plate for sensing the relative position of the pressure plate. Several pressure pistons at a distance from each other can be provided in the pressure plate, which pressure pistons in each case pass through corresponding openings in the pressure plate. Several pistons upon non-use can be retracted and then be flush with the bottom side of the pressure plate. A sensor can be disposed at the pressure plate for determining physical parameters of the subgrade. Such parameters include water contents, density, elasticity and the like. A device can be provided for sampling the subgrade material.

A hydraulic jack can be associated with the pressure piston having its case attached to the pressure plate for mounting the piston and a displacement pick-up can signal the distance of the pressure piston form the bottom of the pressure plate. A pressure sensor can be provided at the input of the hydraulic press, an analog to digital converter can be connected to the pressure sensor, a process computer can be connected to the analog to digital converter, a plotter can be connected to the process computer and a memory unit can be connected to the process computer. An operator cabin can contain the analog to digital converter, the process computer and the memory unit. The pressure plate can be curved substantially corresponding to the radius of the motion described by the means for removing supporting material. The pressure piston can be provided with a bore at the bottom suitable for receiving a sample from the subgrade.

There is also provided a method for investigating the track of a rail system which comprises excavating a hole at the interspace between cross-ties of a track with a means disposed on a rail vehicle, moving the rail vehicle into a second position, lowering a test unit attached at the end of said vehicle into the hole, pressing the bottom of the hole with a pressure plate attached to the test unit and pushing a pressure piston through a hole in the pressure plate into the subgrade.

The displacement and the pressure applied of the pressure plate and of the pressure piston can be determined and the relationship of pressure applied and the displacement of pressure plate and/or pressure piston can be computed and the resulting values can be plotted. The properties of the subgrade can be sensed with sensing devices attached to the pressure plate. The test unit can be removed from its position at the end of said rail vehicle with the same means, preferably the excavator, employed in excavating the hole.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings,

BRIEF DESCRIPTION OF THE DRAWINGS

In the accompanying drawings, in which is shown one of the various possible embodiments of the invention.

DESCRIPTION OF INVENTION AND PREFERRED EMBODIMENT

Figure 1:
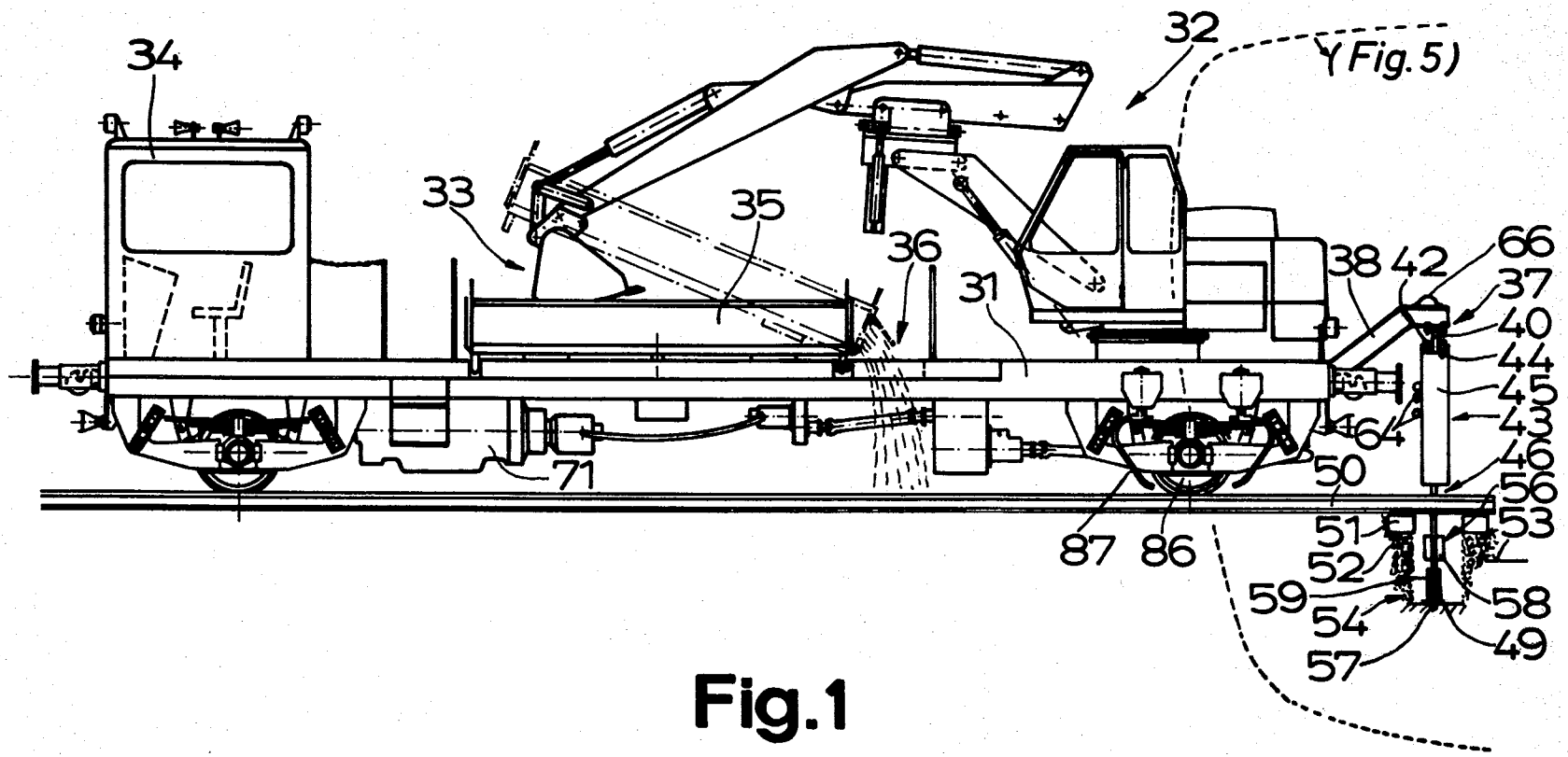
FIG. 1 is a schematic side view of the rail vehicle according to the invention.

In accordance with the present invention there is provided a support provision at the rail vehicle and the support provision in turn carries the measuring unit. At the frame of the measuring unit connected to the support provision there is disposed a pressure plate which can be lifted up or lowered down with reference to the frame. The pressure plate can be in its rest position at a sufficiently elevated height above the track for avoiding interference with line travel. In its use form the pressure plate can be lowered to below the formation level under application of a steady pressure on the supporting area. An opening is provided in the pressure plate for a pressure piston moving substantially vertical to the pressure plate, which piston presses in the subgrade to be tested.

This rail vehicle according to the invention allows to clear within a relatively short time the interspace between two cross-ties, to perform the necessary tests and to fill, pack and tamp the interspace again such that the track is again available for the regular traffic. Thus the rail vehicle can use short operational intervals for performing several measurements. In order to allow the rail vehicle to move fast to the point of application and then to move on, the rail vehicle is preferably provided with a drive system for self-propelled motion. The rail vehicle of the invention therefor allows an immediate and reproducible measurement according to recognized test methods even with a rapid sequence of trains and a high density traffic line, that is just of those lines, where investigations of the formation level are most necessary and where such investigations thus far could not be performed without other disadvantages.

Advantageously, the measurement unit is disposed horizontally slidable and cross, in particular at a right angle, to the direction of motion of the rail vehicle and is guided at the support provision. By way of simple shifting the measurements relating to soil mechanics can be performed in a simple way between and beyond of the rails. Furthermore, even when the rail vehicle is standing at a curved rail section the measurement unit can be positioned at a desired distance from the rails. In particular a girder can be employed as a longitudinal guide and the girder can be as long as possible and as allowed by the allowable regular clearance gauge. The girder can be disposed at the end of the rail vehicle beyond of the bumpers. This provides for a good shifting in the cross direction and furthermore the dug out hole can be easily, freely and uninhibited inspected and also manual work can be performed in the dug out hole without interference by the rail vehicle. The position of the measurement unit at the end of the rail vehicle also alleviates the work during the night, for which the invention rail vehicle is equipped in order to allow a wide range of applications. An advantageous feature provides that the support girder is connected via a jack provision with the support arm such that the girder can be lowered down to the rails. Thereby the rail vehicle is lifted up and loads the support girder for obtaining a reference plane.

With such a position of the measurement provision and of the support provision regular line travel is not permitted, in particular as the measurement unit is located beyond the bumpers. Advantageously, the two parts are mounted for easy removal such that they can be rapidly demounted for line travel and that they can also again be put rapidly in place after a line travel. It is recommended for this purpose to position the support provision and the measurement unit within the operating area of the excavator, which also means decisive advantages for the course of operation, and to provide both the support provision as well as the measurement unit with eyelets such that both parts can be conveniently moved by way of the excavator.

A typical course of operation of the rail vehicle according to the invention runs as follows: As long as the track section to be investigated is still closed, the rail vehicle waits standing on a passing track. As soon as the track is cleared the rail vehicle moves with its own drive system to the track section to be investigated. At this place the support provision and then the measuring unit are mounted and at the same time the digging of the hole at the interspace of two cross-ties is started. The material removed is intermediately stored in a dumping provision, where ballast, subgrade material and the like remain separate from each other. The dumping provision allows later on a very rapid refilling of the hole in the interspace. Now the pressure plate is lowered to the bottom of the hole between the cross-ties and is pressed against the floor of the hole to such amount that the pressure prevailing before the digging is reestablished at this position. The pressure plate prevents a welling up on the sides when the pressure piston is pressed into the material of the formation level. On the one hand the pressure piston can be pressed down with a preset speed, where the force required for this is determined and plotted and on the other hand it can be provided to employ one or more, graded or constant pressures and in each case determine the depth of impression reached in the time unit. For determining sufficient values relating to the soil mechanics an additional amount of for example about 30 cm of subgrade material are removed after the digging of the hole to the formation level and in the larger depth the same measurement is performed. Alternatively, also a pressure piston can be employed which starting with the formation level can be pressed into the below lying subgrade by 30 cm or more, which would save the further digging out. Finally it is recommended to provide a bore open to the bottom in the pressure piston, which collects material from the subgrade in a sequence corresponding to the layers present and which material is available for later analysis.

The measurement values are automatically collected and recorded such that the course of the measurements proper is performed very rapidly and precisely. Measurements typically are taken every fifty meters, however the distances of the measurement locations can be changed at any time and in particular based on the immediately available measurement results a decision can be formed practically immediately about a deviating distance between measurement locations. By way of automatic data collection it is possible to provide a comprehensive representation over the length of an investigated track section.

After termination of the measurements the rail vehicle advances so far that its dumping case is disposed above the dug out interspace between two cross-ties. The interspace hole is now filled in and distributors take care that neither the rails nor the middle of the track are directly filled with material. After the packing and tamping of the location investigated the rail vehicle travels to the next measurement location or, in case the time is not sufficient for another measurement, back to the passing track. Since an individual complete measurement course takes only short time, it can be understood that also high traffic track sections can be investigated in this way without interfering with regular operations.

Referring now to FIG. 1 there is shown a two-axle vehicle body 31 having above the axle on the right side of FIG. 1 disposed a short tail excavator 32 with a narrow gripper 33. In the area of the other end there is positioned on the rail vehicle an operator cabin 34. Between the operator cabin 34 and the excavator 32 there is provided a dumping provision 35 within the operating radius of the excavator. The dumping provision 35 can be put in the dumping position toward the left side and toward the right side as well as in a third position shown in FIG. 1 with dash-dotted lines, where the material located in the dumping provision is emptied through a discharging opening 36 or chute.

A support provision 37 is disengageable attached at the end region on the excavator side of the rail vehicle. The support provision 37 comprises a support arm 38 slid into the front side of the rail vehicle body 31 and the arm 38 is held safe in position with an arm 39 and a girder 40 disposed at a right angle to the vehicle axis. The girder is within the clearance gauge 41. The support arm 38 and the girder 40 are produced from I-profile beams (also called double T-beams). A measuring unit 43 hangs with rollers 42 at the two lower flanges of the girder 40 and the measurement unit 43 can be moved in the logitudinal direction of the girder 40. The path available to the rollers 42 is limited at the ends of the girder 40 by limit stops 44. These limit stops 44 are in each case formed as a bolt and a nut and they can be easily removed such that the measurement unit 43 can be easily and rapidly removed from the girder 40.

Figure 2:
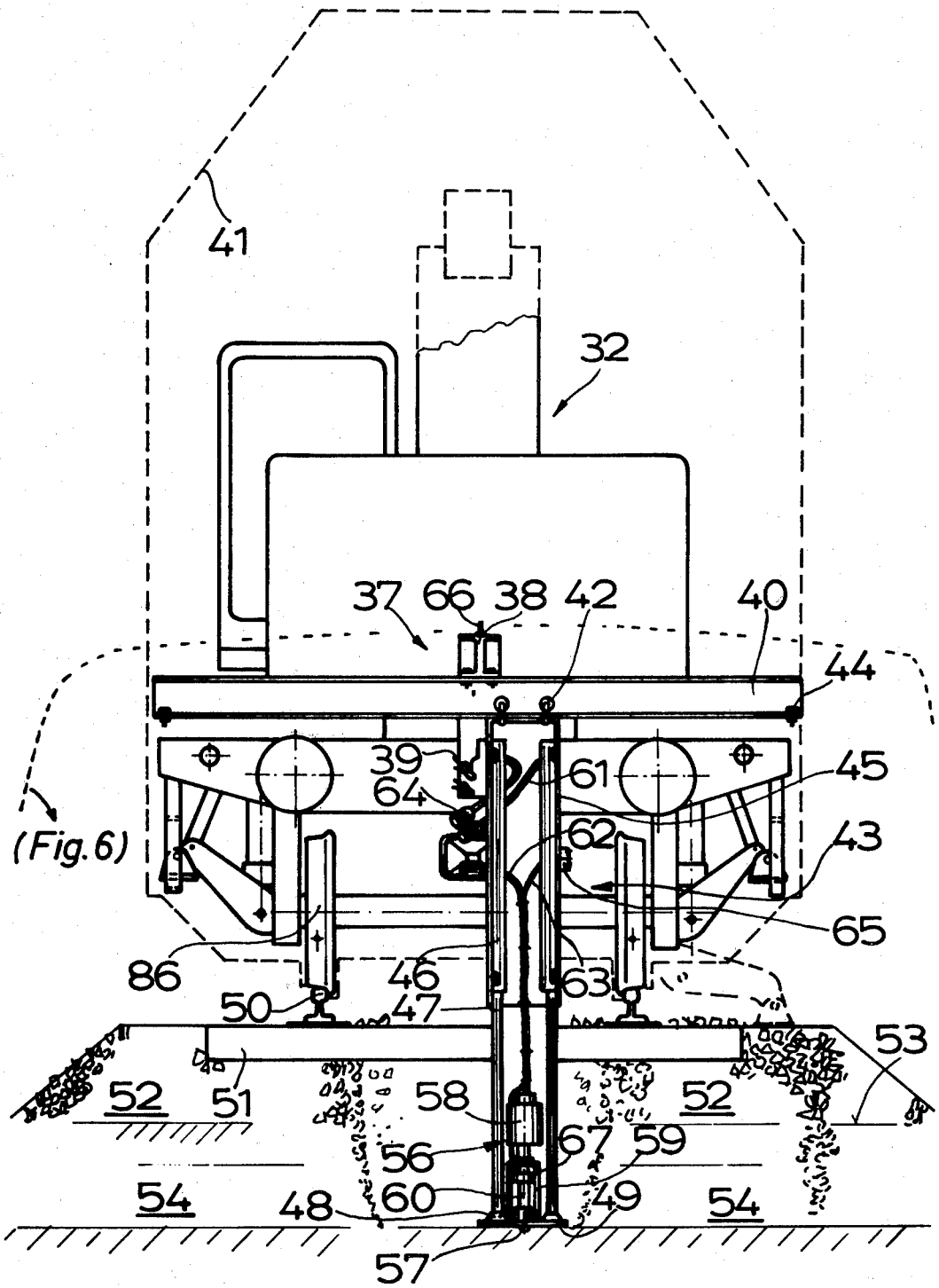
FIG. 2 is a schematic front view of the rail vehicle on the end region where the excavator is disposed.
Figure 3:
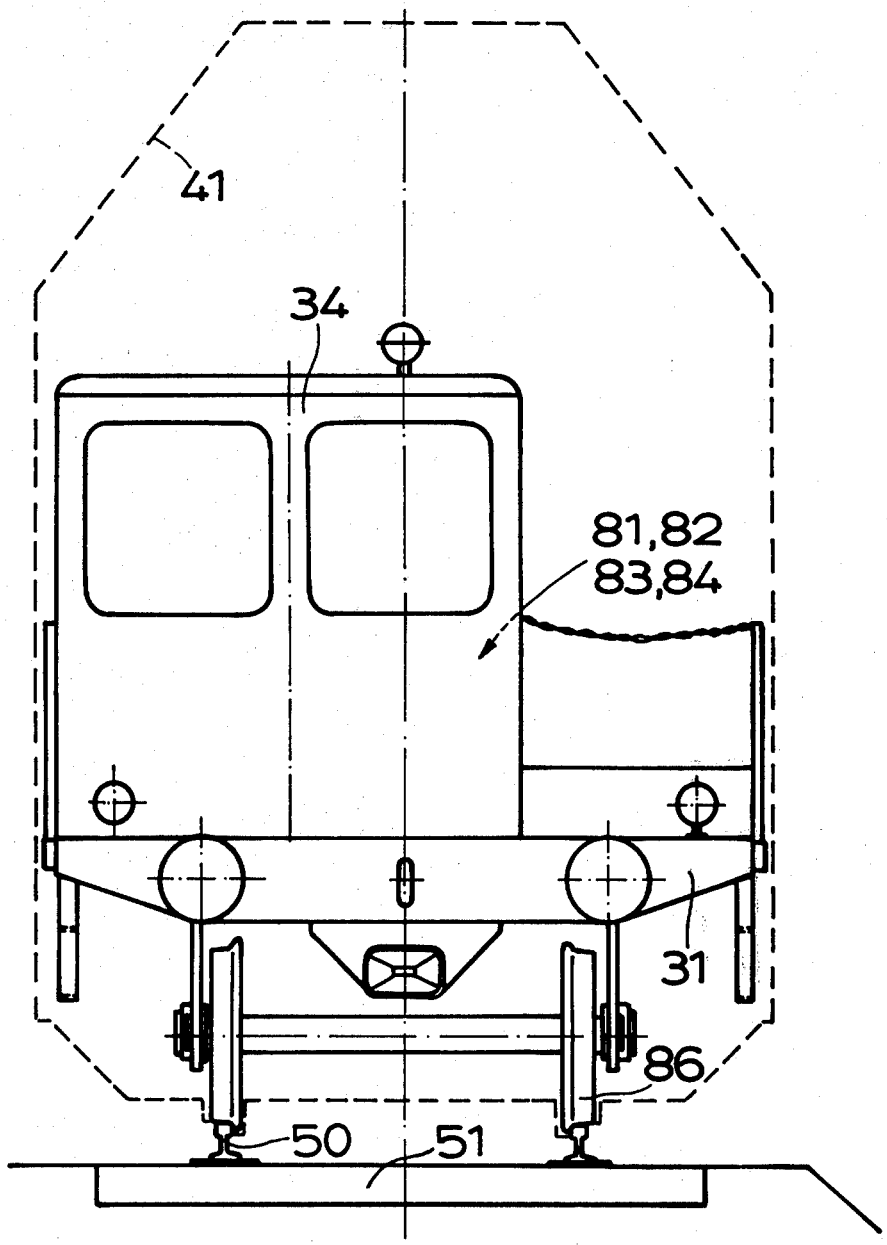
FIG. 3 is another schematic front view of the other end region of the rail vehicle.
Figure 4:
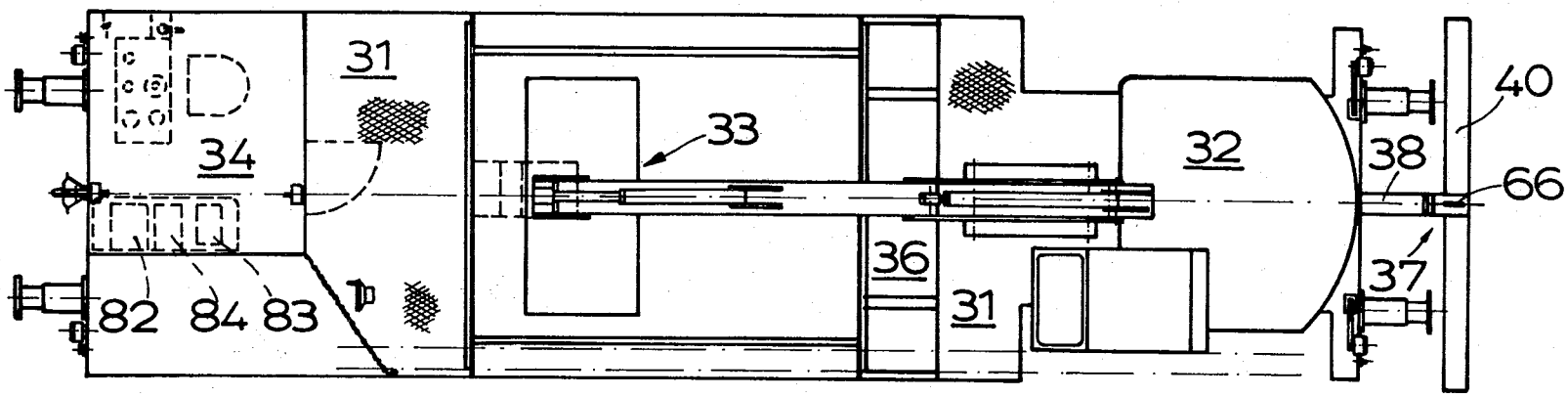
FIG. 4 is a schematic plan view of the rail vehicle.
Figure 5:
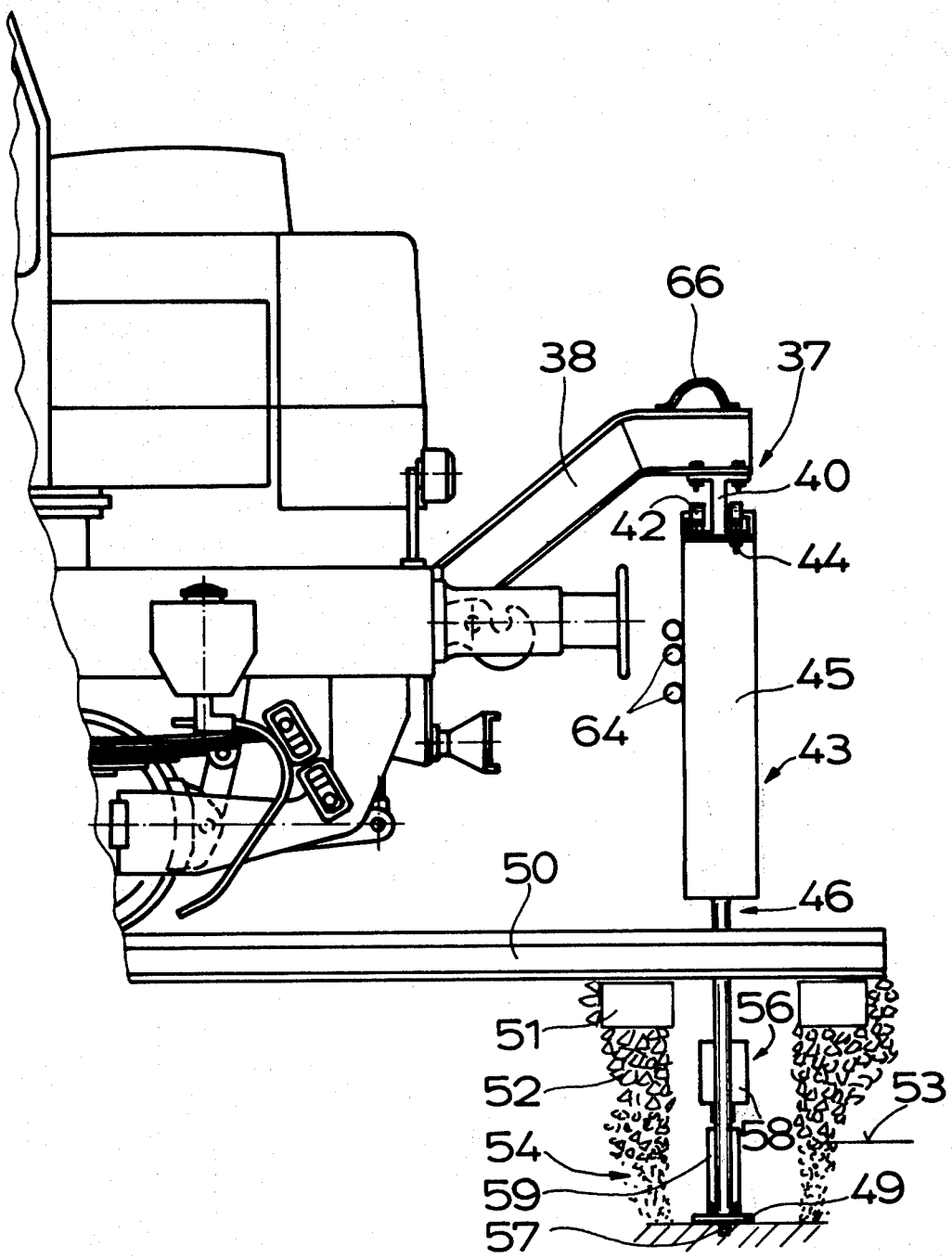
FIG. 5 is a schematic enlarged view of part of FIG. 1 as designated in FIG. 1.
Figure 6:
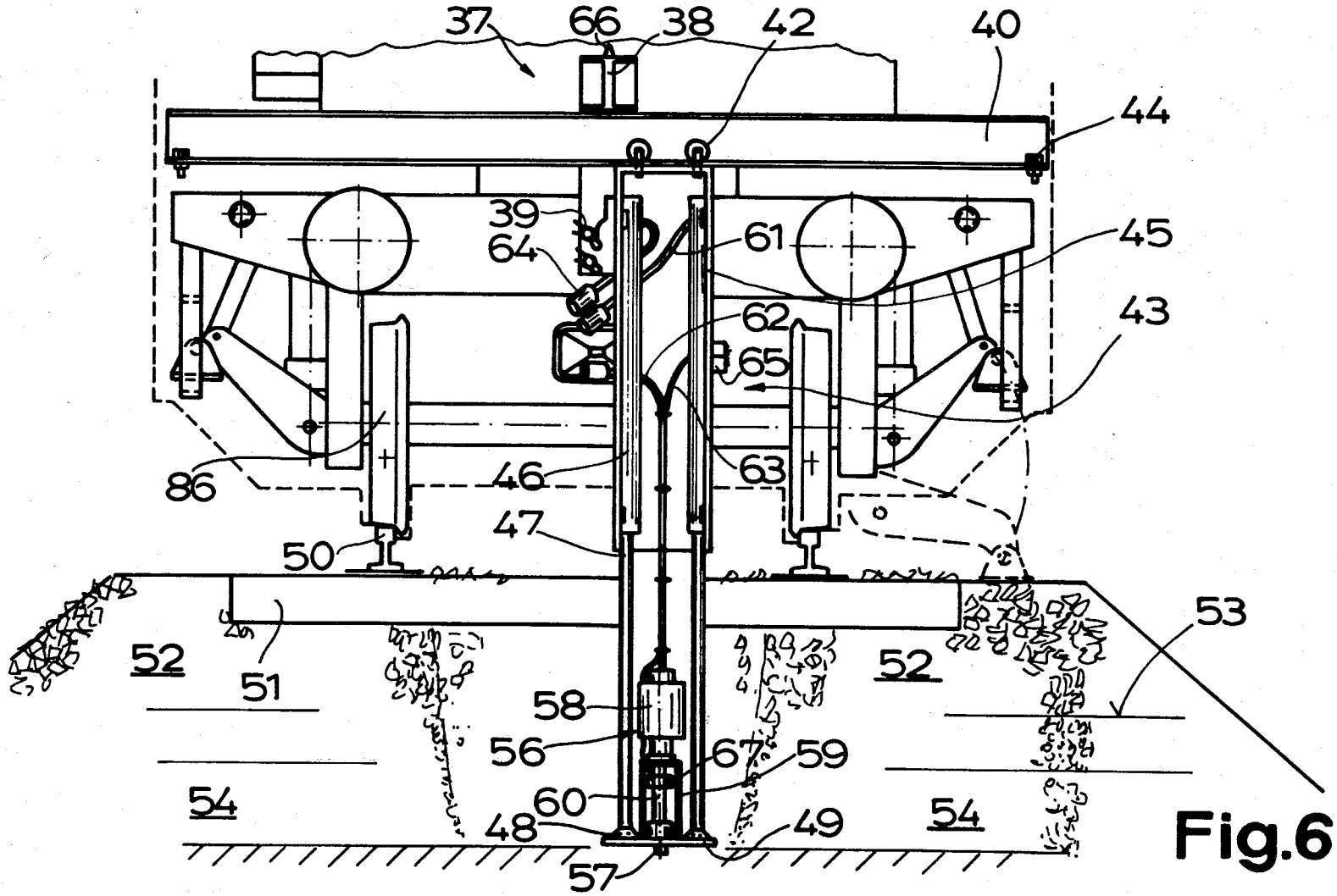
FIG. 6 is a schematic enlarged view of part of part of FIG. 2 as designated in FIG. 2.

FIGS. 2, 5 and 6 show details of the support provision 37 and in particular of the measurement unit 43. As shown the measurement unit 43 comprises a frame 45 having solidly disposed the rollers 42 at it upper end. Two hydraulic jacks, that is cylinders and pistons 46 are attached to the frame 45 and the piston rods 47 can be simultaneously lowered to the bottom by about 1 meter. At the free bottom end of these piston rods 47 there is held a rectangular pressure plate 49 in each case with a joint 48. The pressure plate can be brought into an upper rest position where the measurement unit is at a sufficient height above the tracks such that the measurement unit 43 does not interfere with line travel. In the lowered position as shown in the Figs. the measurement unit is available for performing the investigations and the pressure plate 49 presses against the subgrade to be investigated.

The construction of the track can be recognized in particular from FIG. 5. As is known rails 50 are supported by cross-ties 51 and these in turn are supported with a ballast bed 52 against the formation level 53. The rail vehicle according to the present invention allows an investigation of the soil mechanics present at below the formation level and in a first measurement the pressure plate 49 is pressed against the formation level. In a second position shown in the Figs. material already is dug out from the formation level region and the pressure plate 49 is now in a position below the formation level 53 for measuring a subgrade layer 54.

An opening 55 is disposed in the pressure plate 49 through which a pressure piston 57 can be pressed into the subgrade layer 54 by way of a hydraulic press 56. The hydraulic press 56 is with its casing 58 attached to the pressure plate 49 by way of a bracket 59. A piston rod 60 of the hydraulic press 56 extendable relative to the pressure plate 49 presses the pressure piston 57 with a constant or in case of an alternate measurement procedure with a varying determined force into the subgrade layer 54. The hydraulic and electrical lines 61,62, 63 leading to the cylinder piston units 46, to the hydraulic press 56 and additional aggregates described below of the measurement unit terminate in automatically closing hydraulic couplings 64 or respectively in a multiple plug 65 such that the outer supply lines not shown in the Figs. can be easily coupled and decoupled, in case the measurement unit 43 is taken down before a longer line travel. For example, the measurement unit can be lifted by the excavator into the dumping provision 35 and the measurement unit is provided with a pull eyelet for this purpose similar to the eyelet 66 shown in FIGS. 1 and 5 disposed at the support arm 38.

Figure 7:
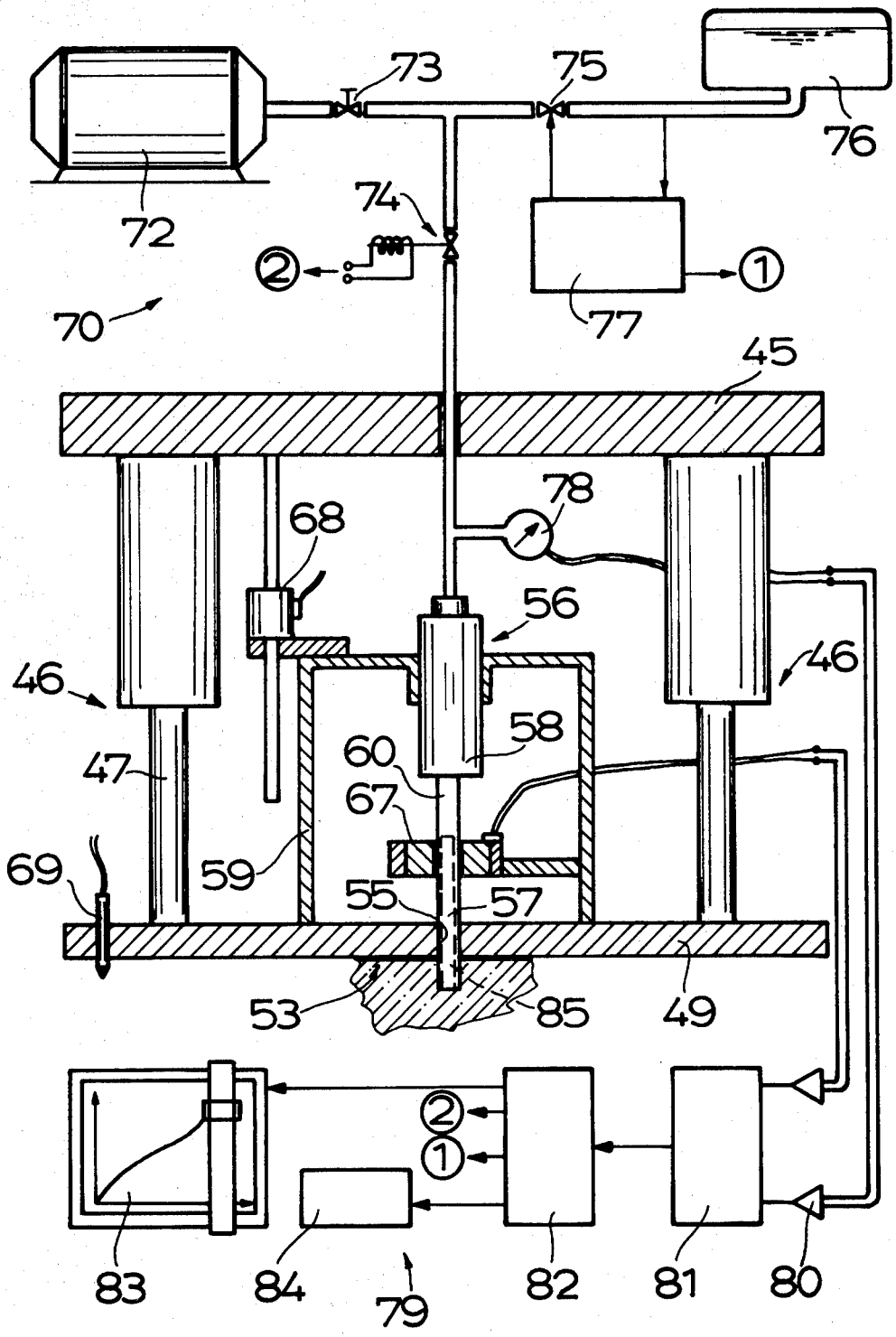
FIG. 7 is a schematic view in principle of the measurement provisions employed according to the invention.

Additional details of the measurement unit employed can be recognized from FIG. 7. This FIG. 7 shows a part of the frame 45 of the measurement unit 43 and the hydraulic cylinders-piston units 46 are attached to the frame 45, which units can lower down or lift up the pressure plate 49 with their piston units. The pressure plate 49 is pressed against the formation level 53 and the pressure piston 57 has already been pressed into the formation level material to a certain extent through the opening 55. The path concluded with respect to the bottom of the pressure plate 49 is recorded by way of the displacement pick-up 67. An additional displacement pick-up 68 (FIG. 7) is located between the pressure plate 49 and the frame 45 and provides indications about a possible settling motion based on the pressure exerted with the pressure plate 49. Finally, a sensor 69 is shown in the pressure plate 49 and this sensor stands by way of example for sensors testing and measuring the parameters of the soil mechanics. For example, the sensor 69 measures the water contents in the area of the formation level 53.

The hydraulic press 56 actuates the pressure piston 57 and is provided with pressure hydraulically via a hydraulic unit 70 not described in detail in the following. A hydraulic pump 72 preferably powered with the rail vehicle engine 71 presses hydraulic liquid via a throttle valve 73 on the one hand via an electromagnetically actuated check valve 74 into the hydraulic press 56 and on the other hand via a valve 75 into the storage container 76. The valve 75 is controlled via a control stage 77 whereby the pressure prevailing in the hydraulic press 56 and measured with the manometer 78 is either adjusted such that the pressure piston 57 enters with constant speed into the formation level 53, whereby the force required for this is provided via the hydraulic pressure or is such preset that the hydraulic pressure assumes values constant over time and then changing by jumps, where the path concluded is determined with the displacement pick-up 67.

The control stage 77 is controlled by a computer 79, which is described in the following. The analog measurement values provided by the displacement pick-up 67 and the manometer 78 as well as the measurement values of additional sensors such as for example 68 and 69 are fed via a preamplifier 80 into a digial to analog converter 81 and are fed to a process computer 82. The process computer transfers the data determined to a plotter 83 such as for example an x-y-t recorder and to a memory unit for storing such as for example a floppy disc 84. The process computer 82 provides via an output line 1 commands to the control stage 77, which adjusts the pressure values described and via line 2 to the valve 74, such that the course of the measurement is controlled automatically.

Furthermore, a bore hole 84 in the pressure piston 57 is shown in FIG. 7 and the subgrade samples can be collected in the bore.

The high weight of the vehicle in the region of the excavator 32 compensates completely for the high reaction forces of the cylinder/piston units 46 and of the hydraulic press 56. The construction of the support provision 37 and of the measurement unit 43 is similar. In order to avoid any danger that the reaction forces effect a shifting of the reference plane of the measurements fixed by the girder 40 or respectively by the rail vehicle body 31, claws can be provided which grip under the rails 50 in the region of the axle on the side where the excavator is located and they load the vehicle spring positively.

In front of and behind the wheels 86 there are disposed in each case rail wipers 87.

The rail vehicle in accordance with the present invention allows a systematical determination of the necessity of formation level improvements in the upper structure in individual track sections according to several criteria. At the same time samples can be taken from the ballast bed 52 in order to determine the degree of soiling of the ballast bed. The investigation of the samples taken with the bore 85 are not performed in the rail vehicle in contrast to the other measurements, but they are investigated in a laboratory as a perturbed sample with respect to grain size distribution and grain line, the state boundary lines and the degree of soiling.

It is an object of the measurements to provide a complete record and a systematic plotting of the test results over the full track range at regular distances of 50 meters and at most 100 meters, where striking points such as prebridges, level crossings, dams and the like are included.

It will be understood that each of the elements described above, or two or more together, may also find a useful application in other types of system configurations and railroad testing procedures differing from the types described above.

While the invention has been illustrated and described as embodied in the context of a rail vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Rail vehicle for track investigation comprising means attached to said vehicle for removing supporting material of the track disposed below the rail level;

a support provision attached to the rail vehicle;

a test unit attached to the support provision including: a frame supported by the support provision;

a pressure plate held by the frame and capable of being lowered down and lifted up and disposed in its upper rest position such that it is at a level above the track region for preventing interference with line travel and capable of being lowered down to below the formation level; and a pressure piston adapted to an opening in said pressure plate and capable of substantially vertical motion relative to the pressure plate for pressing into the subgrade to be tested.

2. The rail vehicle according to claim 1 further comprising a drive system attached to the rail vehicle for providing power for moving the rail vehicle.

3. The rail vehicle according to claim 1 wherein the means for removing supporting material includes an excavator; and a narrow gripper built on the excavator.

4. The rail vehicle according to claim 1 wherein the means for removing supporting material is adapted for clearing of the interspace between crossties including the side areas down to the foundation level.

5. The rail vehicle according to claim 1 wherein the pressure plate is adapted for providing a steady contact pressure on the surface to be tested.

6. The rail vehicle according to claim 1 wherein the test unit is guided for motion horizontally and cross to the direction of motion of the rail vehicle.

7. The rail vehicle according to claim 1 wherein the supporting provision includes a girder running cross to the direction of motion of the rail vehicle; and a support arm connecting the girder to the rail vehicle and disposed at the end of the rail vehicle body protruding freely beyond the bumpers of the rail vehicle.

8. The rail vehicle according to claim 7 wherein the girder is connected to the support arm through a jack and can be lowered to the rails while the rail vehicle is lifted up loading with its weight the support arm for providing a reference plane.

9. The rail vehicle according to claim 1 wherein the support provision is located at the same side of the vehicle where the means for removing supporting material is disposed and wherein the support provision and the test unit include a handle for being engaged by the means for removing.

10. The rail vehicle according to claim 9 wherein the handle is an eyelet.

11. The rail vehicle according to claim 1 further comprising a hydraulic jack disposed vertically between the frame and the pressure plate disposed below the frame said jack engaging the pressure plate with a joint.

12. The rail vehicle according to claim 1 further comprising a displacement pick-up disposed between the frame and the pressure plate for sensing the relative position of the pressure plate.

13. The rail vehicle according to claim 1 wherein several pressure pistons at a distance from each other are provided in the pressure plate, which in each case pass through corresponding openings in the pressure plate.

14. The rail vehicle according to claim 13 wherein the several pistons upon non-use are retracted and flush with the bottom side of the pressure plate.

15. The rail vehicle according to claim 1 further comprising a sensor disposed at the pressure plate for determining physical parameters of the subgrade; and a device for sampling the subgrade material.

16. The rail vehicle according to claim 1 further comprising a hydraulic jack associated with the pressure piston having its case attached to the pressure plate for mounting the pressure piston; and a displacement pick-up signalling the distance of the pressure piston from the bottom face of the pressure plate.

17. The rail vehicle according to claim 16 further comprising a pressure sensor at the input of the hydraulic press; an analog digital converter connected to the pressure sensor;

a process computer connected to the analog-digital converter;

a plotter connected to the process computer; and a memory unit connected to the process computer.

18. The rail vehicle according to claim 17 further comprising an operator cabin containing the analog-digital converter, the process computer and the memory unit.

19. The rail vehicle according to claim 1 where the pressure plate is curved substantially corresponding to the radius of the motion described by the means for removing supporting material.

20. The rail vehicle according to claim 1 wherein the pressure piston is provided with a bore at the bottom suitable for receiving a sample from the subgrade.

21. A method for investigating the track of a rail system comprising excavating a hole at the interspace between cross-ties of a track with a means disposed on a rail vehicle; moving the rail vehicle into a second position; lowering a test unit attached at the end of said vehicle into the hole;

pressing the bottom of the hole with a pressure plate attached to the test unit; and pushing a pressure piston through a hole in the pressure plate into the subgrade.

22. The method for investigating according to claim 21 further comprising determining the displacement and the pressure applied of the pressure plate and of the pressure piston;

computing the relationship of pressure applied and the displacement of pressure plate and/or pressure piston; and plotting the computed values.

23. The method for investigating according to claim 21 further comprising sensing the properties of the subgrade with test devices attached to the pressure plate.

24. The method for investigating according to claim 21 further comprising removing the test unit from its position at the end of said vehicle with the same means employed in excavating the hole.

* * * * *